US005505318A

United States Patent [19]

Goff

[11] Patent Number: 5,505,318

[45] Date of Patent: Apr. 9, 1996

[54] COLLAPSIBLE RACK

[75] Inventor: Gerald L. Goff, Austin, Tex.

[73] Assignee: Advanced Micro Devices, Inc., Sunnyvale, Calif.

[21] Appl. No.: 186,299

[22] Filed: Jan. 24, 1994

[51] Int. Cl.[6] ..... E04G 5/00; A47F 5/00

[52] U.S. Cl. ..... 211/90; 211/150; 211/132

[58] Field of Search ..... 211/90, 96, 104, 211/150, 149, 195, 132; 108/134, 108, 99

[56] References Cited

U.S. PATENT DOCUMENTS

| | | | |
|---|---|---|---|
| 421,540 | 2/1890 | Barber | 211/132 |
| 1,158,212 | 10/1915 | Henderson | 211/149 X |
| 1,986,078 | 1/1935 | Spang | 211/150 X |
| 2,922,683 | 1/1960 | Schmertz | 108/134 X |
| 2,928,551 | 3/1960 | Abrams et al. | 211/90 X |
| 3,295,471 | 1/1967 | Cook | 211/150 X |
| 4,678,090 | 7/1987 | Ross | 211/150 |
| 4,819,900 | 4/1989 | Funk | 108/108 X |

FOREIGN PATENT DOCUMENTS

| | | | |
|---|---|---|---|
| 731996 | 6/1955 | United Kingdom | 211/149 |

*Primary Examiner*—Karen J. Chotkowski
*Attorney, Agent, or Firm*—Jenkens & Gilchrist

[57] ABSTRACT

An apparatus for storing articles includes a rack, structure for supporting the rack, structure for rotatably connecting the rack to the structure for supporting so that the rack can rotate from a first stable position described by a horizontal plane to a second stable position described by a vertical plane, structure for fixedly holding the rack when the rack is in the first stable position; and structure for fixedly holding the rack when the rack is in the second stable position.

6 Claims, 2 Drawing Sheets

COLLAPSIBLE RACK

BACKGROUND OF THE INVENTION

1. Field of the Invention

The present invention relates to racks used to hold work-in-progress in microchip fabrication laboratories. More particularly, the present invention relates to a collapsible version of such a rack that can be folded out of the way in order to facilitate maintenance on laboratory equipment located in close proximity to the rack.

2. Description of Related Art

Microchip fabrication laboratories must be kept clean and must be isolated from exterior environments to prevent atmospheric particulates and other impurities from contaminating wafers as they are produced. Contamination can result in performance degradation and decreased reliability. Because of strict environmental control requirements, space is often at a premium in these "clean" laboratories. As a result, storage locations for work-in-progress must be collocated with process equipment and both must be tightly arranged to conserve limited space.

The microchip fabrication process consists of three basic operations: layering, patterning, and doping. In the layering process, thin layers of different materials are grown on, or added to, the wafer surface. Portions of these thin layers are selectively removed to form desired circuit patterns. Dopants are then used to change the conductivity characteristics and resistivity of selected regions in the wafer surface.

The actual number of steps the wafer goes through will vary with the type and complexity of the circuit being constructed. There are several variations on each of the basic operations described above and each variation is designed to achieve a somewhat different result. By iteratively layering, patterning, and doping the surface of the wafer, complex integrated circuits can be produced.

During the normal course of the fabrication process, wafers must be stored on work-in-progress racks. To prevent contamination and to avoid costly transportation requirements, these work-in-progress racks must be located in the same clean rooms as the process equipment. A typical fabrication laboratory consists of tightly packed process equipment with work-in-progress racks located next to each workstation.

In the past, stationary racks have been used to store work-in-progress. These stationary racks are the type often found in medical laboratories. They have four legs and stand on the ground. They are made of oxidation-resistant stainless steel and thereby minimize the risk of particulate contamination. Under ideal operating conditions the stationary work-in-progress racks effectively perform their function. However, operating conditions are rarely ideal.

The sophisticated process equipment used in microchip fabrication periodically requires maintenance. In a typical fabrication laboratory with thirty-six etchers, there will always be a few units down for maintenance. Much of this equipment requires side-panel or back-panel access for maintenance activities. Because of the tightly packed configurations in a clean room, access is restricted by the presence of work-in-progress racks.

When a piece of process equipment requires maintenance, the adjacent stationary work-in-progress racks must be moved to provide adequate access to the equipment. Since a loaded rack could be holding millions of dollars worth of products, and since racks may tip when being relocated, loaded racks are virtually always unloaded prior to being moved. A problem is caused by the limited space in the clean laboratory. When a stationary work-in-progress rack is moved, it will still take up valuable space. If only one work-in-progress rack must be moved, space can usually be found for it. Frequently, however, multiple units will be down for maintenance and several racks will be displaced at the same time. Some of them must inevitably be moved to inconvenient locations such as in walkways or in front of doors.

Based upon the foregoing, it should be understood and appreciated that prior art racks used to hold work-in-progress in microchip fabrication laboratories have a number of shortcomings and deficiencies.

SUMMARY OF THE INVENTION

The present invention overcomes the shortcomings and deficiencies mentioned above by providing an apparatus for storing articles, which apparatus includes a rack, structure for supporting the rack, structure for rotatably connecting the rack to the structure for supporting the rack so that the rack can rotate from a first stable position described by a horizontal plane to a second stable position described by a vertical plane, structure for fixedly holding the rack when the rack is in the first stable position, and structure for fixedly holding the rack when the rack is in the second stable position.

Accordingly, an object of the present invention is to provide a piece of equipment for use in a microchip fabrication facility, the use of which piece of equipment facilitates access between process machines in order to perform maintenance.

BRIEF DESCRIPTION OF THE DRAWINGS

Other objects, advantages, and novel features of the present invention will become apparent from the following detailed description of the invention when considered in conjunction with the accompanying drawings in which.

DETAILED DESCRIPTION OF THE INVENTION

Figure 1:
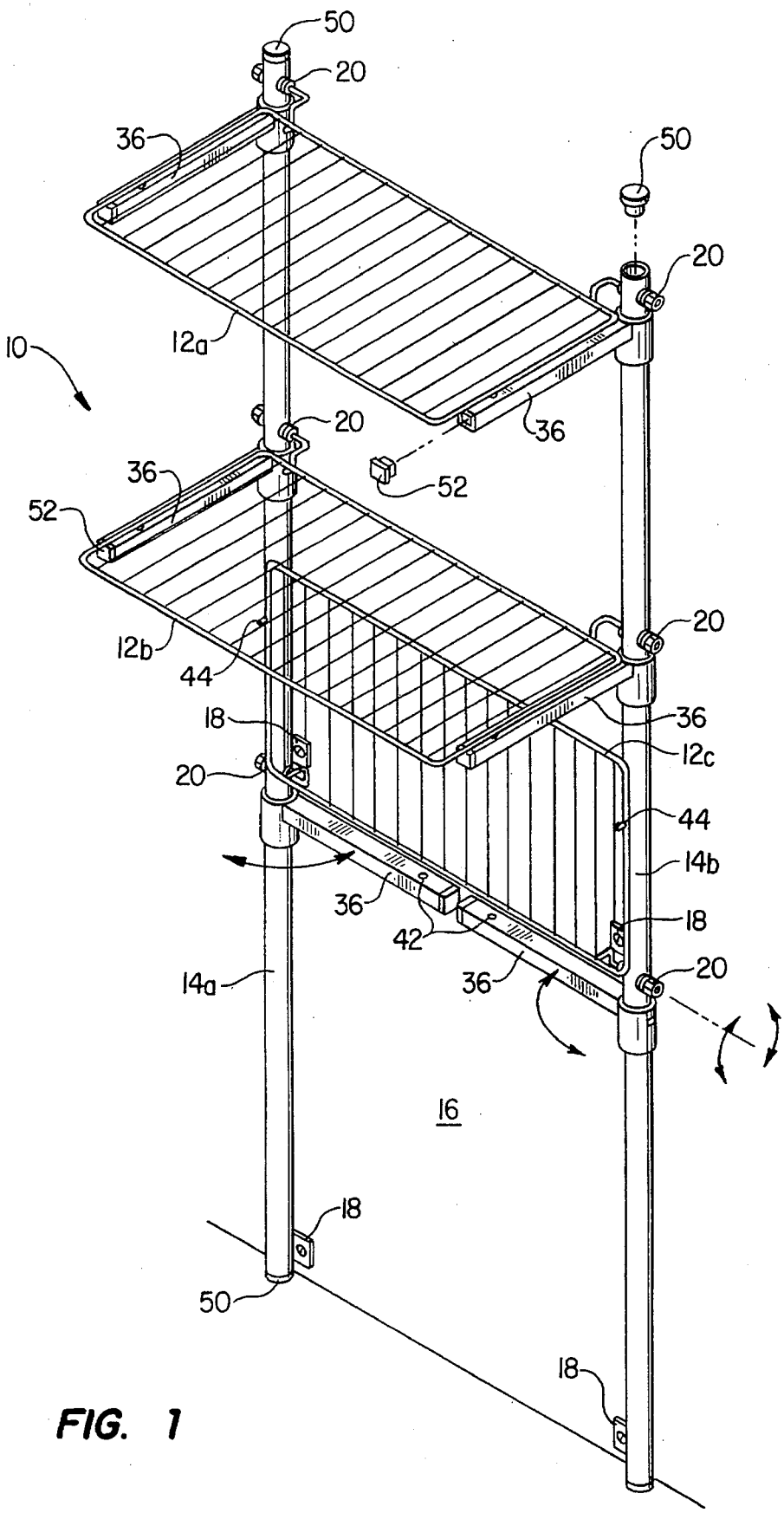
FIG. 1 is a perspective view of a collapsible rack according to the teachings of the present invention.

Referring now to the drawings wherein like or similar elements are designated with identical reference numerals throughout the several views, wherein the elements depicted are not necessarily shown drawn to scale, and, more particularly, to FIG. 1, there is shown an apparatus according to the teachings of the present invention (generally designated by reference number 10). The apparatus 10 depicted in FIG. 1 may be seen to comprise three shelves 12*a*, 12*b*, 12*c* connected to two vertical support rods 14*a*, 14*b* which may be, in turn, connected to a wall 16. Shelves 12*a* and 12*b* are shown in FIG. 1 in what is called herein the "deployed" position, that is, they are protruding outward horizontally from the wall 16 so as to present flat surfaces for holding articles such as work-in-progress in microchip fabrication facilities, medical items in a laboratory, or the like. Shelf 12*c*, on the other hand, is depicted in FIG. 1 in what is called herein the "stand-by" position, that is, shelf 12*c* is positioned parallel to the wall 16 so as to occupy a minimal amount of space. Shelf 12*c* cannot, of course, be used to hold articles as can shelves 12*a* and 12*b;* however, shelf 12*c* is not obstructing any movement around it, as shelves 12*a* and 12b are. Apparatus 10, in addition to including at least one shelf or rack 12 and structure 14 for supporting that rack 12, also includes structure for rotatably connecting the rack 12 to the structure 14 so that the rack 12 can rotate from the stand-by to the deployed position, and vice-versa, and the apparatus 10 also includes structure for fixedly supporting the rack 12 when the rack is in either the stand-by or deployed position. Details regarding all of the structure forming various embodiments of the present invention are set forth below.

The racks 12 depicted in FIG. 1 may be seen to be formed of a number of rigid, parallel bars. Such construction, as opposed to a solid shelf, facilitates viewing items on the shelf from lower angles and it also helps to prevent undesired materials from collecting on the shelf. Ideally, the rack 12 would be constructed of an oxidation-resistant material. This will prolong life of the rack and reduce maintenance requirements. With special regard to the apparatus 10, it is important to note that the racks 12 have protrusions on their left and right bottom portions. The purpose of these protrusions will become clear based upon further descriptions hereinbelow.

The two vertical support rods 14*a,* 14*b* depicted in FIG. 1 may be seen therein to include mounting brackets 18 to enable them to be mounted onto the wall 16. The two vertical support rods 14*a,* 14*b* are not directly connected but are indirectly connected by the shelves or racks 12. Like the racks 12, and for the same reasons, the rods 14*a,* 14*b* are ideally made out of rigid, oxidation-resistant material. It may also be seen in FIG. 1 that each of the support rods 14 includes a hole 20 therethrough for each of the racks 12. Accordingly, each of the rods 14 in the embodiment of FIG. 1 has three holes 20 therethrough. Associated with each such hole is a pin cavity 22, one of which is clearly depicted in FIG. 2. It may be seen in FIGS. 1 and 2 that the pin cavities 22 are generally in the rear of vertical support rods, and that they are offset downward from the holes associated with them. The purpose of this arrangement will become clear based upon further descriptions hereinbelow.

Figure 2:
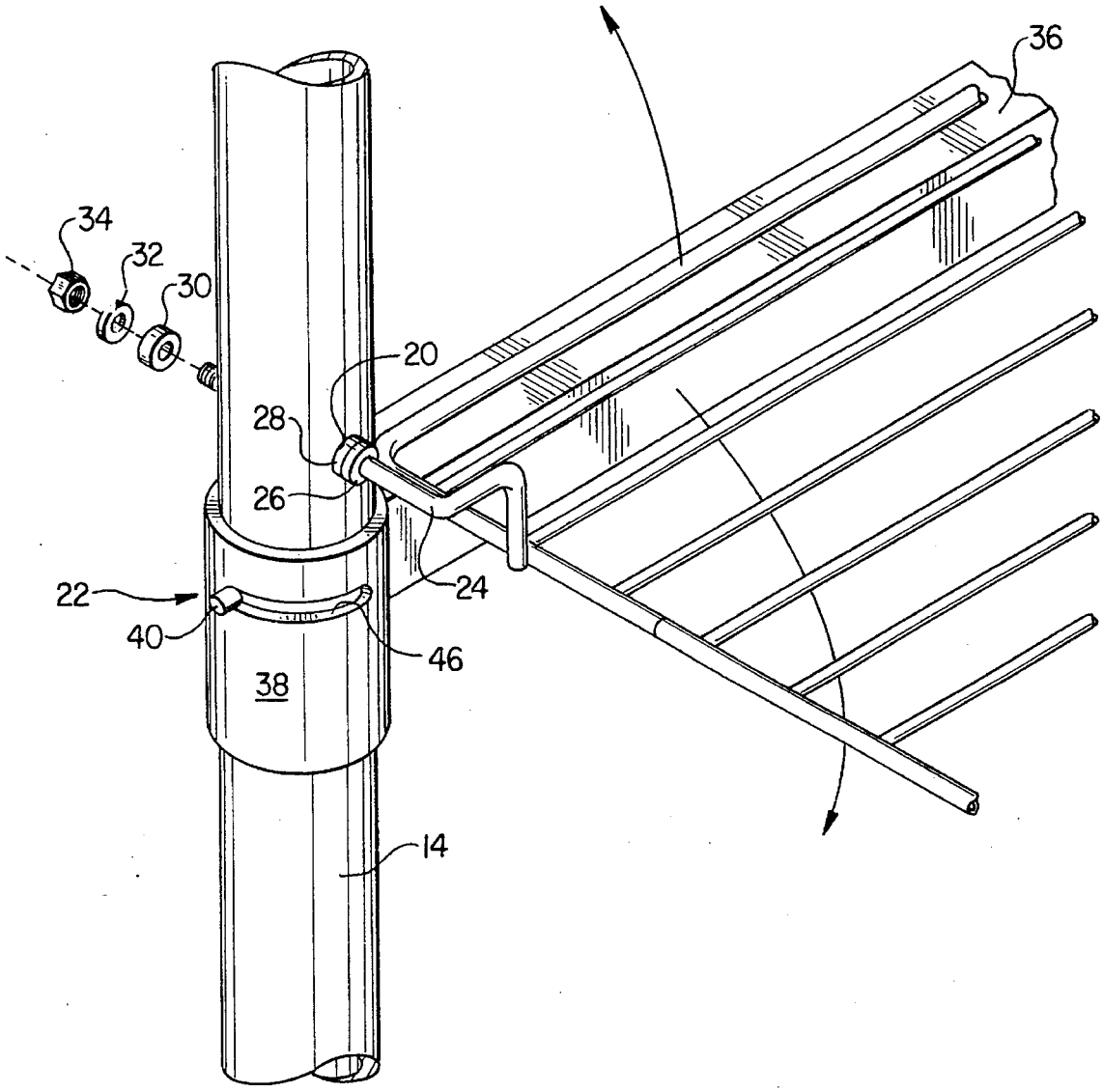
FIG. 2 is a detailed view of a portion of the collapsible rack depicted in FIG. 1.

Although several of them are depicted in FIG. 1, best seen in FIG. 2 is another element of the apparatus 10: a hinge member 24. Each hinge member in apparatus 10 has one end thereof fixed to a rack 12 and a second end thereof, which is threaded, inserted wholly through a hole 20 in a vertical support rod 14. It should be appreciated by those skilled in the art that such an arrangement, that is, an arrangement wherein each rack 12 is hingedly connected to two parallel mounted vertical support rods 14, allows each rack 12 to rotate about a horizontal axis aligned with the holes 20. Such a rotation can orient each rack 12 in a deployed position described by a horizontal plane just above the pin cavities 22 mentioned above, and such a rotation can also orient each rack in a stand-by position described by a vertical plane adjacent to the front (i.e., the portion facing away from the wall 16) of the vertical support rods 14.

Although many variations are possible, the particular arrangement whereby each hinge member 24 is connected to a vertical support rod 14 in apparatus 10 will now be described. The particular arrangement used, which is most easily seen in FIG. 2, uses four washers (which, for convenience in describing, will be called herein the first, second, third, and fourth washers) and a nut. The first washer 26, ideally made of a rigid oxidation-resistant material, is larger in diameter than the horizontal hole and is secured to the hinge member 24 at a location offset by a distance greater than the width of the vertical support rod 14 from the end of the threaded section of the hinge member 24. The second washer 28, ideally made of nylon, is also larger in diameter than the horizontal hole, fits on the threaded section of the hinge member, and is sized so as to not slide past the first washer. The third washer 30, also ideally made of nylon, is also larger in diameter than the horizontal hole; is placed on the threaded section of the hinge member 24 after the threaded section of the hinge member 24 has been secured to the first washer 26, passed through the second washer 28, and then passed through the horizontal hole 20 of the vertical support rod 14. The fourth washer 32, ideally formed of rigid oxidation-resistant material, is larger in diameter than the horizontal hole 20 and is placed on the threaded section of the hinge member after the third washer 30. The nut 34, also ideally formed from a rigid oxidation-resistant material, is tightened onto the threaded section of the hinge member 24 after the fourth washer 32 has been put into place so that the force applied between the nut 34 and the first washer 26 prevents axial displacement of the hinge member 24 and so that sufficient friction is generated to maintain the rack's orientation when it is in the stand-by position. Such friction is the means, discussed above, for fixedly holding the rack 12 when the rack 12 is in the vertical, stand-by position.

The apparatus 10 also comprises six cantilever support beams 36, each of which are attached to a support rod 14 via a collar or sleeve 38 (see FIG. 2) and a pin mechanism 40 (once again, see FIG. 2). Generally, the cantilever support beams fall into one of two categories: those connected to the leftmost support rod 14, which swing outwardly from the wall 16 in a clockwise manner, and those connected to the rightmost support rod 14, which swing outwardly from the wall 16 in a counterclockwise manner (see FIG. 1). Both types of support beams have holes 42 (best seen in FIG. 1) on the upper surface thereof, which holes 42 are designed to receive the protrusions on the racks mentioned above, which protrusions are designated with reference numeral 44 in FIG. 1. Quite simply, beginning with the support beams 14 and an associated rack 12 flush against the wall 16, the two support beams 36 can be swung outwardly so as to be orthogonally disposed with respect to the wall 16, and then the rack 12 can be lowered so that its protrusions 44 enter into the holes 42 in the beams. In this manner, the rack 12 may be fixedly held in the deployed position described above. Slots 46 through the collars or sleeves 38 of the cantilever support beams 36 together with the pins 40 on the vertical support rods 14 provide a mechanism whereby the support beams' movement can be controlled and limited (this is the cavity arrangement 22 referred to hereinabove). In constructing an embodiment of the present invention, the pins 40 can be spring-biased. Such an arrangement would allow sliding connection of the support beams 36 to the vertical support rods 14. Embodiments of the present invention, like the embodiment depicted in the FIGS., may include protective plastic caps 50 on the ends of the vertical support rods 14 as a means to protect against the rods and damage and abrasion. As also shown in FIG. 1, each of the cantilever support beams 36 may likewise have a protective plastic cap 52 attached to the front end of the beam as a means for guarding the protruding end of the beam from damage and abrasion. Also, as previously mentioned, embodiments of the present invention may be mounted to a wall. This connection can be effected with screws, nails, or with any of a number of other fastening means. Those skilled in the art should now fully understand and appreciate how the present invention provides storage in a tight space. If a particular shelf is not being used, or if it is in the way, it can readily be moved out of the way. Such a collapsible rack mechanism holds great promise for employment in areas such as microchip fabrication rooms, where the racks can be readily collapsed to gain access to process equipment for maintenance and the like. Obviously, numerous modifications and variations are possible in view of the teachings above. Accordingly, within the scope of the appended claims, the present invention may be practiced otherwise than as specifically described hereinabove.

What is claimed is:

1. An apparatus for storing articles, said apparatus comprising:

(a) a rack;

(b) a plurality of vertical support rods perpendicularly intersected by a conceptual horizontal axis, said vertical support rods having ends and a front;

(c) means for rotatably connecting said rack to said vertical support rods, said means for rotatably connecting allowing said rack to rotate about said conceptual horizontal axis from a first stable position described by a horizontal plane to a second stable position described by a vertical plane;

(d) a plurality of cantilever support beams, each of said cantilever support beams having a predefined axis and a protruding end, a notch in a top surface of the beam near the protruding end of the beam, a cylindrical sleeve at a back end of the beam spaced from said protruding end of the beam, said cylindrical sleeve being disposed at a selectively variable position on one of said vertical support rods and having an axis perpendicularly oriented with respect to the axis of said support beam, an inner diameter large enough to allow a close fit around a preselected one of said vertical support rods, and a horizontal slot extending through the sleeve;

(e) a pin extending radially outwardly from the preselected vertical rod at a selected vertical position along said rod and having a diameter small enough to pass through the horizontal slot in said sleeve so that said cantilever beam is maintained at a selected vertical position and is rotatable about the vertical rod between a stand-by position described by a plane shared by said vertical support rods and a deployed position protruding from the front of said vertical support rods and occupying a horizontal plane below said rack in said first stable position so that while said cantilever support beams are in a deployed position and said rack is in a first stable position, said cantilever support beams provide support and stabilization for said rack; and (f) means for fixedly holding said rack when said rack is in said second stable position.

2. The apparatus as recited in claim 1, wherein said vertical plane describing said second stable position is adjacent to the front of said vertical support rods.

3. The apparatus as recited in claim 1, wherein said rack is made of rigid oxidation-resistant material, and wherein said vertical support rods are made of rigid oxidation-resistant material, and further wherein said cantilever support beams are made of rigid oxidation-resistant material.

4. The apparatus as recited in claim 1, wherein said rack further comprises a left side and a right side, said left side and said right side of said rack each having a bottom, said bottom of said left side and said bottom of said right side of said rack each having a protrusion thereon; and wherein each cantilever support beam further comprises a top, said top of each said cantilever support beam having a notch positioned to mate with a corresponding protrusion in said rack when said rack is in said first stable position and said cantilever support beam is in said deployed position.

5. The apparatus as recited in claim 1, further comprising:

(a) means for protecting said ends of said vertical support rods from damage and abrasion; and (b) means for guarding said protruding ends of said cantilever support beams from damage and abrasion.

6. An apparatus for storing articles in an area, said apparatus comprising:

(a) a rack made of rigid oxidation-resistant material, said rack having a left side and a right side, said left side and said right side of said rack each having a bottom, said bottom of said left side and said bottom of said right side of said rack each having a protrusion thereon;

(b) two vertical support rods made of rigid oxidation-resistant material, each having a horizontal hole passing through said vertical support rod from side-to-side, and each also having a pin cavity in the rear of said vertical support rod that is offset downward from said horizontal hole;

(c) two hinge members made of rigid oxidation-resistant material, each having one end fixed to said rack and each having a threaded section at the other end capable of passing through the horizontal hole in the respective vertical support rod so that said rack can rotate about a horizontal axis aligned with said horizontal holes and so that this rotation can orient said rack in a deployed position described by a horizontal plane just above the pin cavities in said vertical support rods as well as in a stand-by position described by a vertical plane adjacent to the front of said vertical support rods;

(d) a first washer made of rigid oxidation-resistant material, which is larger in diameter than said horizontal hole and which is secured to said hinge member at a location offset by a distance greater than the width of the vertical support rod from the end of the threaded section of said hinge member;

(e) a second washer made of nylon, which is larger in diameter than said horizontal hole and which will fit on the threaded section of the hinge member but will not slide past the first washer;

(f) a third washer made of nylon, which is larger in diameter than said horizontal hole and which is placed on the threaded section of the hinge member after said threaded section of said hinge member has been secured to the first washer, passed through the second washer, and then passed through the horizontal hole of the vertical support rod;

(g) a fourth washer made of rigid oxidation-resistant material, which is larger in diameter than said horizontal hole and which is placed on the threaded section of the hinge member after said third washer;

(h) a nut made of rigid oxidation-resistant material, which is tightened onto the threaded section of the hinge member after said fourth washer has been put in place so that the force applied between said nut and said first washer will prevent axial displacement of said hinge member and so that sufficient friction is generated to maintain the rack's orientation when it is in the stand-by position;

(i) a first cantilever support beam with a first notch on the top of said first cantilever support beam near the front end of said first cantilever support beam and with a first cylindrical sleeve at the back end of said first cantilever support beam, the axis of said first cylindrical sleeve being perpendicularly oriented with respect to the axis of said first cantilever support beam and having an inner diameter large enough to allow a close fit around the vertical support rod and further having a first horizontal slot around the first cylindrical sleeve from the back of said first cylindrical sleeve to a point ninety degrees around said first cylindrical sleeve in a clockwise direction viewed from the top of said first cantilever support beam;

(j) a second cantilever support beam with a second notch on the top of said second cantilever support beam near the front end of said second cantilever support beam and with a second cylindrical sleeve at the back end of said second cantilever support beam, the axis of said second cylindrical sleeve being perpendicularly oriented with respect to the axis of said second cantilever support beam and having an inner diameter large enough to allow a close fit around the vertical support rod and further having a second horizontal slot around the second cylindrical sleeve from the back of said second cylindrical sleeve to a point ninety degrees around said second cylindrical sleeve in a counterclockwise direction viewed from the top of said second cantilever support beam;

(k) a first pin that is small enough to pass through the first horizontal slot of the first cantilever support beam and that is fixed in the pin cavity of the vertical support rod so that the first cantilever support beam will be held in place vertically and will be able to rotate around the axis of the vertical support rod between a stand-by position in the plane between the vertical support rods and a deployed position protruding from the front of the vertical support rod and so that when the first cantilever support beam is in the deployed position and the rack is in the deployed position, the rack will rest on the first cantilever support beam in order to provide support for the deployed rack and so that the short protrusion on one side of the rack will fit in the first notch in order to provide stabilization for the deployed rack;

(l) a second pin that is small enough to pass through the second horizontal slot of the second cantilever support beam and that is fixed in the pin cavity of the vertical support rod so that the second cantilever support beam will be held in place vertically and will be able to rotate around the axis of the vertical support rods between a stand-by position in the plane between the vertical support rods and a deployed position protruding from the front of the vertical support rods and so that when the second cantilever support beam is in the deployed position and the rack is in the deployed position, the rack will rest on the second cantilever support beam in order to provide support for the deployed rack and so that the short protrusion on one side of the rack will fit in the second notch in order to provide stabilization for the deployed rack;

(m) a first protective cap that can be attached to each end of the vertical support rods;

(n) a second protective cap that can be attached to the front ends of the first and second cantilever support beams; and (o) means for stabilizing the vertical support rods with respect to the areas in which the apparatus is to be located.

* * * * *

UNITED STATES PATENT AND TRADEMARK OFFICE

CERTIFICATE OF CORRECTION

PATENT NO. : 5,505,318

DATED : April 9, 1996

INVENTOR(S) : Goff, Gerald L.

It is certified that error appears in the above-indentified patent and that said Letters Patent is hereby corrected as shown below:

Column 4, line 56, Delete "against"
After "the rods"
Insert --against --.
Delete the first occurrence of "and ".

Signed and Sealed this

Twelfth Day of November, 1996

*Attest:*

Bruce Lehman

BRUCE LEHMAN

*Attesting Officer*

*Commissioner of Patents and Trademarks*